US007096922B2

(12) United States Patent
Hemschemeier et al.

(10) Patent No.: US 7,096,922 B2
(45) Date of Patent: Aug. 29, 2006

(54) COPPER CASTING MOLD

(75) Inventors: Hans-Juergen Hemschemeier, Ennigerloh (DE); Ralf Rethmann, Osnabrueck (DE); Ju rgen Merker, Kahla (DE); Dirk Rode, Osnabrueck (DE); Gerhard Hugenschuett, Belm (DE); Hark Schulze, Osnabrueck (DE); Frank Maiwald, Westercappeln (DE); Hans-Guenter Wobker, Bramsche (DE)

(73) Assignee: KM Europa Metal AG, Osnabruck (DE)

( * ) Notice: Subject to any disclaimer, the term of this patent is extended or adjusted under 35 U.S.C. 154(b) by 20 days.

(21) Appl. No.: 10/463,097

(22) Filed: Jun. 17, 2003

(65) Prior Publication Data

US 2003/0230394 A1 Dec. 18, 2003

(30) Foreign Application Priority Data

Jun. 17, 2002 (DE) ..... 102 27 034

(51) Int. Cl.
*B22D 11/00* (2006.01)
*B22D 11/06* (2006.01)

(52) U.S. Cl. ..... 164/418; 164/428; 164/429

(58) Field of Classification Search ..... 164/418, 164/459, 479–482, 429–433, 428
See application file for complete search history.

(56) References Cited

U.S. PATENT DOCUMENTS

| | | | | | |
|---|---|---|---|---|---|
| 4,197,902 | A | * | 4/1980 | Von Jan et al. | 164/418 |
| 4,404,232 | A | * | 9/1983 | Evertz | 427/8 |
| 4,787,228 | A | * | 11/1988 | Weisner et al. | 72/47 |
| 5,014,768 | A | * | 5/1991 | Waters et al. | 164/418 |
| 5,230,380 | A | * | 7/1993 | Sato | 164/418 |
| 5,499,672 | A | * | 3/1996 | Nakashima et al. | 164/418 |
| 2002/0153123 | A1 | * | 10/2002 | Unal | 164/480 |
| 2003/0205357 | A1 | * | 11/2003 | Unal | 164/480 |

FOREIGN PATENT DOCUMENTS

| | | | |
|---|---|---|---|
| JP | 54-2224 | * | 1/1979 |
| JP | 54-4235 | * | 1/1979 |
| JP | 54-4237 | * | 1/1979 |
| JP | 55-45514 | * | 3/1980 |
| JP | 59-73153 | * | 4/1984 |

* cited by examiner

*Primary Examiner*—Kuang Y. Lin
(74) *Attorney, Agent, or Firm*—Kenyon & Kenyon LLP

(57) ABSTRACT

A copper casting mold for the continuous casting of steel melts is provided, in the presence of zinc and or sulfur in the thermally most greatly stressed contact region with the steel melt, with an at least single-layer diffusion barrier layer made of at least one metallic/metalloid material.

8 Claims, 2 Drawing Sheets

COPPER CASTING MOLD

FIELD OF THE INVENTION

The present invention relates to a copper casting mold for the continuous casting of steel melts in the presence of zinc and/or sulfur.

BACKGROUND INFORMATION

In the use of copper casting molds for the continuous casting of steel melts, premature damage occurs in the presence of zinc and/or sulfur in the thermally most highly stressed contact regions with the steel melts.

In this context, zinc as a component, for example, of molten automobile scrap (zinc as corrosion protection) reacts with the hot copper surface, and, in a diffusion process, it forms brittle $\alpha/\beta/\gamma$ brass phases. These split off, and as a result they lead to crack formation.

Sulfur, which is present, for instance, because of auxiliary casting materials, reacts with copper to form high volume and brittle copper sulfides. These may split off too. The notch effect created by local corrosion in this respect is consequently an ideal starting point for the formation of cracks.

SUMMARY

The present invention is based on making available a copper casting mold for the continuous casting of steel melts in the presence of zinc and/or sulfur which has a clearly longer service life, without the heat flow, and with it the cooling performance of the copper casting mold being influenced in a relevant way.

In an exemplary embodiment of the present invention the copper casting mold is provided with a diffusion barrier layer in the thermally most highly stressed contact region with the steel melt.

In an exemplary embodiment of the present invention such a single-layer diffusion barrier layer may be made of metals or metalloids, whose solubility by zinc and/or sulfur is negligible in the range of the temperatures in which they are used. Among these materials are in particular ruthenium (Ru), rhenium (Re), tantalum (Ta), silicon (Si), boron (B), tungsten (W), chromium (Cr), and niobium (Nb). If only zinc is present, molybdenum (Mo), titanium (Ti), rhodium (Rh) and tellurium (Te) may also find application.

The diffusion barrier layer may be applied directly to a copper surface of a copper casting mold with the aid of a CVD (chemical vapor deposition) process or a PVD (physical vapor deposition) process.

It is also conceivable that the diffusion barrier layer might be applied to chromium or to other galvanic layers.

Furthermore, a diffusion barrier layer may also be developed as an intermediate layer before the application of a hard-facing layer made, for instance, of chromium and/or nickel.

The selection of the type of layer is determined by two factors. On the one hand, the chief aim of a diffusion barrier must be fulfilled. On the other hand, the absolutely essential condition of good adhesion as intermediate layer or cover layer must be satisfied.

A further possibility of designing a diffusion barrier layer is chromium oxide as the cover layer. Its solubility by zinc and/or by sulfur is negligible in the temperature range in which copper casting molds are used. The chromium oxide may be produced by a thermal/chemical treatment of a chromium layer, e.g. in a oxidizing atmosphere. This has the advantage that not only is the surface per se protected by an oxide from the diffusion of zinc and/or sulfur into the chromium, but also that the typically ever-present microcracks and macrocracks of the chromium layer are closed off by the oxide.

Moreover, it is conceivable within the scope of the present invention, that a chromium layer of at least one type is deposited as the diffusion barrier layer. For this, crack-free, microcrack and standardized hard layer types may be combined. The combination is performed such that no cracks traverse from the layer surface to the base material, or become thus traversing during use. Especially suitable, for example, may be a layer construction of an intermediate layer made up of crack-free or microcrack chromium and having a cover layer of standard hard chromium applied on top of it.

The present invention also permits that, as the diffusion barrier layer, a layer of carbides, nitrides, borides or even oxides and their mixed types are developed, for instance, based on titanium/aluminum (Ti/Al) and chromium (Cr). In this connection, carbides, nitrides and borides are suitable as intermediate layers. Oxides are rather to be used as cover layers. The present invention envisages favorable properties especially in the use of aluminum nitride (AlN), aluminum oxide ($Al_2O_3$), chromium carbide (CrC), chromium nitride (CrN), titanium carbide (TiC), titanium nitride (TiN), titanium carbonitride (TiCN), titanium aluminum nitride (TiAlN) and titanium boride (TiB2).

A diffusion barrier layer may also be formed by applying an aluminum compound, such as aluminum nitrate, to the surface, such as a chrome-plated surface, of a copper casting mold. By that application, the surface layer of the casting mold is wetted completely by the salt solution and infiltrated. By annealing at a moderate temperature, decomposition takes place to $\gamma$-aluminum oxide ($Al_2O_3$) on the entire surface as well as in the microcracks and the open pores. Consequently, here too, diffusion of zinc and sulfur, and thus brass formation and sulfur corrosion, are prevented. The application of aluminum nitrate solution may be performed by dipping, spraying or applying using a brush or roll. The protective effect of the infiltration may be reinforced by multiple dipping or application.

Also conceivable is a combination of copper as the mold material using nickel for protection against wear, along with one of the above-mentioned diffusion barriers.

In an exemplary embodiment of the present invention a diffusion barrier layer may also be created by applying suitable lacquers, resins or plastics to the surface of a copper casting mold, e.g. a chrome-plated surface. Suitable materials are especially lacquers, resins or plastics based on silicon or epoxide. By the application, the surface layer of the casting mold is completely wetted and infiltrated. During aging at room temperature or a higher temperature, the application hardens or oxidizes over the whole surface as well as in the microcracks and the pores in the coating lying below it. Here too, the diffusion of zinc and sulfur, and consequently brass formation and sulfur corrosion are prevented.

In an exemplary embodiment of the present invention the diffusion barrier layer is formed from a ceramic material.

In an exemplary embodiment of the present invention the copper casting mold is made of a tube mold or plate mold and the diffusion barrier layer may be applied in the upper half, and there, expediently in the upper one-quarter or one-third of the mold length.

In an exemplary embodiment of the present invention a tube mold or plate mold is utilized and the diffusion barrier layer is provided especially at the height range of the bath level. In this context, the diffusion barrier layer is applied at a height which is sufficient, during oscillation of the bath level, completely to cover the contact surface that is thermally highly stressed overall. Typically, this range lies about ±50 mm above and below the bath level line, or approximately in a range up to a distance of about 250 mm from the upper edge of the tube mold or plate mold. Advantageously the range is between 50 mm and 250 mm, preferably 150 mm to 200 mm from the upper edge.

In an exemplary embodiment of the present invention a revolving mold (casting roll, casting roller) is provided with a diffusion barrier layer which is located on the entire circumference that is in contact with the steel melt.

In-house experiments have shown that, the diffusion barrier layer should have a thickness of 0.002 mm through 0.3 mm. A exemplary thickness of the diffusion barrier layer may be be 0.005 mm through 0.1 mm.

In an exemplary embodiment of the present invention a multilayer layer may also be formed as the diffusion barrier layer. In a multilayer layer, several layers and layer materials are combined with one another.

DETAILED DESCRIPTION

Figure 1:
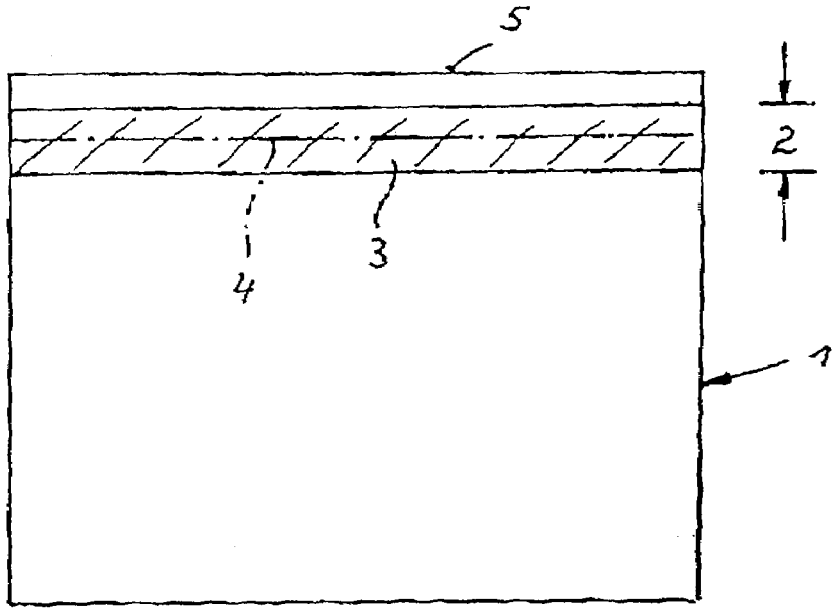
FIG. 1 is a schematic view of a mold plate with a view of a casting plate.

In FIG. 1, the reference numeral 1 denotes a mold plate made of copper. Hatched region 2 illustrates the greatest thermally stressed contact region with a steel melt. It is provided with a diffusion barrier layer 3. Bath level 4 is indicated by a dotted and dashed line. Bath level 4 is able to oscillate vertically, so that, to cover region 2, diffusion barrier layer 3 extends about 50 mm above and below bath level 4. In other words, bath level 4 may also lie at a distance of about 150 mm through 200 mm from upper edge 5 of plate mold 1. Diffusion barrier layer 3 is made of a metallic material.

Figure 2:
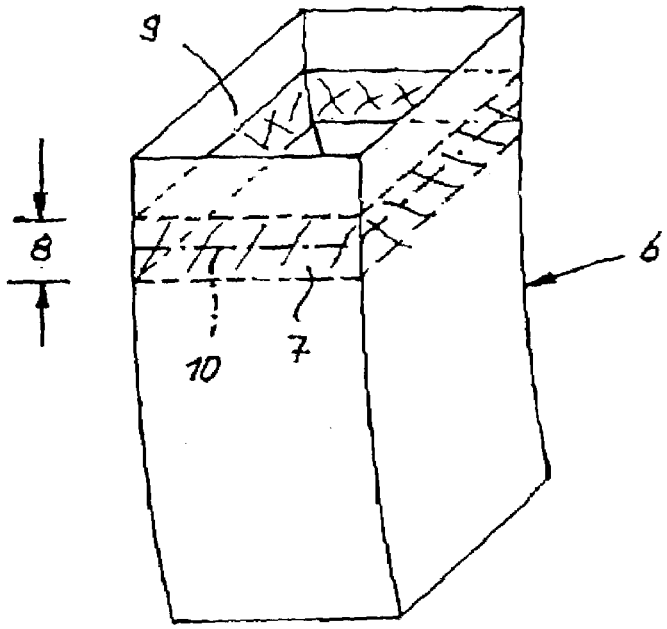
FIG. 2 is a schematic view of a tube mold in perspective.

In FIG. 2 a tube mold 6 is indicated schematically. Here too, a diffusion barrier layer 7, made of a metal/metalloid material, is illustrated, which lies in a region 8 that is at a distance of about 150 mm through 200 mm from upper side 9 of tube mold 6. The range of the height from bath level 10 amounts to about 50 mm.

Figure 3:
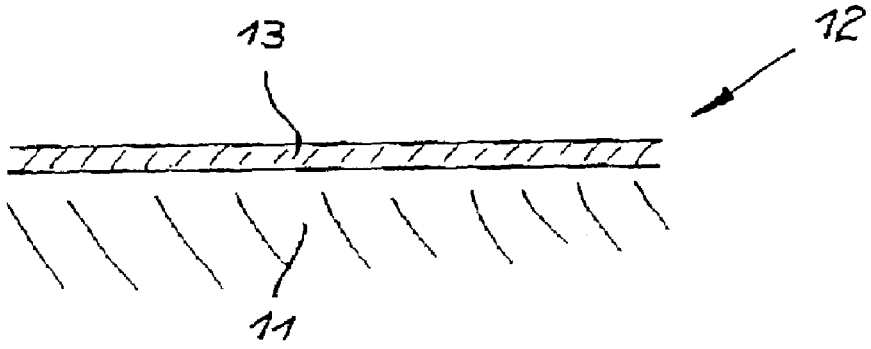
FIG. 3 is a longitudinal section of a single-layer diffusion barrier layer applied to the base material of a casting mold.

FIG. 3 illustrates in longitudinal section, base material copper 11 of a casting mold 12 such as a plate mold or tube mold 1, 6 or of a revolving mold, such as a casting roller or casting roll. To this base material 11 a single-layer diffusion barrier layer 13 has been applied, made, for example, of aluminum oxide ($Al_2O_3$).

Figure 4:
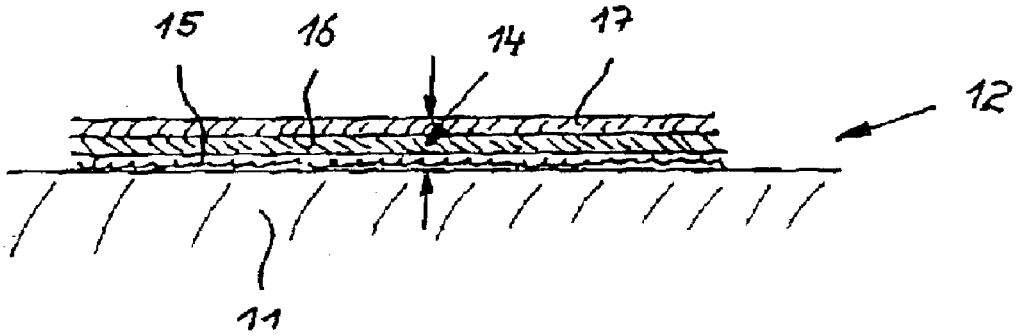
FIG. 4 is a longitudinal section of a multilayer layer applied to the base material of a casting mold.

In FIG. 4, 11 in turn, denotes the base material copper of a casting mold 12. A multilayer layer 14 has been applied to base material 11, and in the exemplary embodiment it is composed of a layer 15 of chromium nitride (CrN) which is in contact with base material 11, a layer 16 of aluminum oxide ($Al_2O_3$) and a layer 17 as cover layer made of titanium nitride (TiN).

Figure 5:
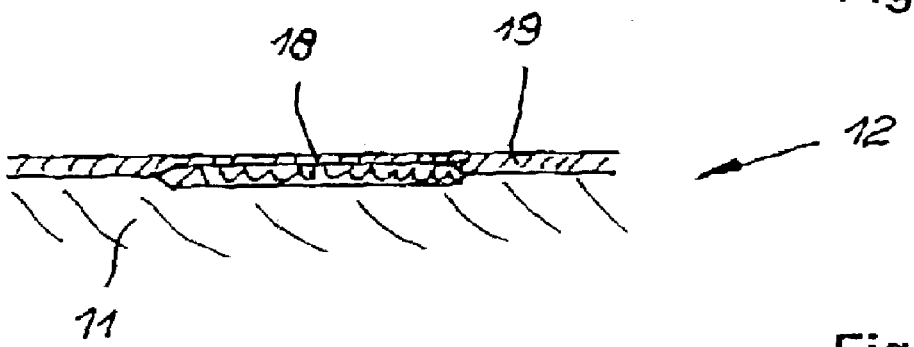
FIG. 5 is a longitudinal section of a single-layer diffusion barrier layer having an intermediate layer, applied to the base material of a casting mold.

In FIG. 5, 11 also denotes the base material copper of a casting mold. A single-layer diffusion barrier layer 18, made, for example, of aluminum nitride (AlN) has been applied to base material 11. In addition, a single-layer hard-facing layer 19, made, for example, of copper and/or nickel, is provided in the transition range from base material 11 copper to diffusion barrier layer 18.

Figure 6:
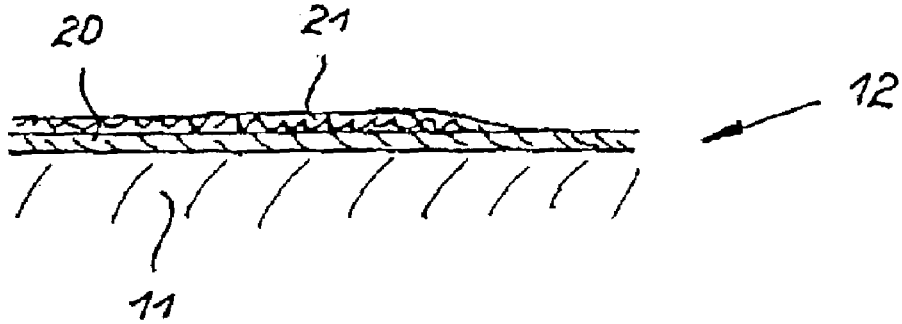
FIG. 6 is a longitudinal section of a barrier layer applied to a protective layer of the base material of a casting mold.

Lastly, in FIG. 6, 11 again denotes base material 11 copper of a casting mold 12. Onto this, a protective layer 20, made of chromium, has been applied, and it in turn is provided with a diffusion barrier layer 21, made of such as aluminum oxide ($Al_2O_3$), which decreases in thickness as it approaches the surface of protective layer 20.

LIST OF REFERENCE NUMERALS

1—mold plate
2—a region of 1
3—diffusion barrier layer
4—bath level
5—upper edge of 1
6—tube mold
7—diffusion barrier layer
8—a region of 6
9—upper side of 6
10—bath level
11—base material of 12
12—casting mold
13—diffusion barrier layer
14—multilayer layer
15—layer of 14
16—layer of 14
17—layer of 14
18—diffusion barrier layer
19—hard-facing layer
20—protective layer
21—diffusion barrier layer

What is claimed is:

1. A copper casting mold arrangement for a continuous casting of-steel melts in a presence at least of one of zinc and sulfur, comprising:

a mold with a diffusion barrier layer in a thermally most greatly stressed contact region with the steel melt, wherein the diffusion barrier layer includes a layer of at least one of carbides, nitrides and borides, wherein the diffusion barrier layer is based on at least one of titanium, aluminum and chromium, wherein the diffusion barrier layer comprises one of aluminum nitride (AIN), aluminum oxide ($Al_2O_3$), chromium carbide (CrC), chromium nitride (CrN), titanium carbide (TiC), titanium nitride (TiN), titanium carbonitride (TiCN), titanium aluminum nitride (TiAIN) and titanium boride ($TiB_2$), and wherein the diffusion barrier comprises a layer of chromium nitride (CrN) directly on the copper casting mold arrangement, a layer of aluminum oxide ($Al_2O_3$) over the layer of chromium nitride (CrN) and an outer layer of titanium nitride (TiN) over the layer of aluminum oxide ($Al_{23}$).

2. The copper casting mold arrangement according to claim 1, wherein the diffusion barrier layer is provided in one of an upper half of a tube mold and a plate mold.

3. The copper casting mold arrangement according to claim 1, wherein the diffusion barrier layer is provided at a region of a height of a bath level of one of a tube mold and a plate mold.

4. The copper casting mold arrangement as according to claim 1, wherein the diffusion barrier layer is provided over an entire circumference of a revolving mold that is in contact with a steel melt.

5. The copper casting mold arrangement according to claim 1, wherein the diffusion barrier layer has a thickness of 0.002 mm through 0.3 mm.

6. The copper casting mold arrangement according to claim 1, wherein the diffusion barrier layer has a thickness of 0.005 mm through 0.1 mm.

7. The copper casting mold arrangement according to claim 1, wherein the diffusion barrier layer is configured as a multilayer layer.

8. The copper casting mold arrangement of claim 1, wherein the diffusion barrier layer further comprises a layer of nickel.

* * * * *